US009702231B2

(12) United States Patent
Elrick

(10) Patent No.: US 9,702,231 B2
(45) Date of Patent: Jul. 11, 2017

(54) TUBING SECTION

(75) Inventor: Andrew Elrick, Dyce (GB)

(73) Assignee: Petrowell Limited, Aberdeen (GB)

( * ) Notice: Subject to any disclaimer, the term of this patent is extended or adjusted under 35 U.S.C. 154(b) by 471 days.

(21) Appl. No.: 12/866,495

(22) PCT Filed: Feb. 23, 2009

(86) PCT No.: PCT/GB2009/000483

§ 371 (c)(1),
(2), (4) Date: Aug. 18, 2010

(87) PCT Pub. No.: WO2009/103999

PCT Pub. Date: Aug. 27, 2009

(65) Prior Publication Data

US 2011/0114332 A1 May 19, 2011

(30) Foreign Application Priority Data

Feb. 21, 2008 (GB) ..... 0803123.9

(51) Int. Cl.
*E21B 17/18* (2006.01)
*E21B 43/12* (2006.01)

(52) U.S. Cl.
CPC ..... *E21B 43/12* (2013.01); *E21B 17/18* (2013.01)

(58) Field of Classification Search
CPC ..... E21B 43/08; E21B 43/12; E21B 43/14; E21B 17/18
USPC ..... 166/369, 373; 138/148, 113; 29/455.1; 285/123.1, 123.2, 123.3, 123.12–123.14, 285/123.15, 123.17
See application file for complete search history.

(56) References Cited

U.S. PATENT DOCUMENTS

| | | | | |
|---|---|---|---|---|
| 643,358 | A | | 2/1900 | Konold |
| 1,909,075 | A | * | 5/1933 | Ricker et al. ..... 285/123.3 |
| 2,009,322 | A | | 7/1935 | Emil |
| 2,181,748 | A | | 11/1939 | Thaheld |
| 2,475,635 | A | * | 7/1949 | Parsons ..... 285/123.15 |
| 2,498,791 | A | | 2/1950 | Clark |
| 2,546,377 | A | | 3/1951 | Turechek |
| 2,703,144 | A | * | 3/1955 | Clifford, Jr. ..... 166/115 |
| 2,738,018 | A | | 3/1956 | Lynes |
| 2,832,418 | A | | 4/1958 | Baker |
| 3,066,738 | A | | 12/1962 | Myers |
| 3,087,552 | A | | 4/1963 | Graham |
| 3,167,127 | A | | 1/1965 | Sizer |

(Continued)

FOREIGN PATENT DOCUMENTS

| | | |
|---|---|---|
| DE | 3812211 | 11/1989 |
| DE | 19827708 | 1/1999 |

(Continued)

OTHER PUBLICATIONS

Pct-gb2005-001391, Int'l Prelim. Report on Patentability, Jun. 23, 2005.

(Continued)

*Primary Examiner* — Kipp Wallace
(74) *Attorney, Agent, or Firm* — Blank Rome LLP

(57) ABSTRACT

The tubing section comprises an outer skin (52*a*) defining at least one perforation (58), an inner skin (54*a*), the inner and outer skins being arranged to define a tubing annulus therebetween and an access device (48) to selectively provide fluid communication between the tubing annulus and a tubing section throughbore.

39 Claims, 3 Drawing Sheets

(56) References Cited

U.S. PATENT DOCUMENTS

| | | | | | |
|---|---|---|---|---|---|
| 3,167,128 | A | | 1/1965 | Sutliff | |
| 3,283,821 | A | | 11/1966 | Brown | |
| 3,342,268 | A | | 9/1967 | Brown | |
| 3,371,716 | A | | 3/1968 | Current | |
| 3,482,889 | A | | 12/1969 | Cochran | |
| 3,623,551 | A | | 11/1971 | Randermann | |
| 3,722,588 | A | | 3/1973 | Tamplen | |
| 3,729,170 | A | | 4/1973 | Lewis | |
| 3,780,802 | A | * | 12/1973 | Phipps et al. | 166/72 |
| 3,889,750 | A | | 6/1975 | Mullins | |
| 4,046,405 | A | | 9/1977 | Bonds | |
| 4,067,596 | A | * | 1/1978 | Kellner et al. | 285/123.3 |
| 4,127,168 | A | | 11/1978 | Hanson | |
| 4,317,485 | A | | 3/1982 | Ross | |
| 4,331,315 | A | | 5/1982 | Geisow | |
| 4,337,563 | A | * | 7/1982 | Becker et al. | 29/451 |
| 4,346,919 | A | | 8/1982 | Morrill | |
| 4,375,240 | A | | 3/1983 | Baugh | |
| 4,412,584 | A | * | 11/1983 | Brandell | 166/169 |
| 4,588,030 | A | | 5/1986 | Blizzard | |
| 4,917,187 | A | | 4/1990 | Burns | |
| 2,230,447 | A | | 2/1991 | Bassinger | |
| 5,058,684 | A | | 10/1991 | Winslow | |
| 5,095,978 | A | | 3/1992 | Akkerman | |
| 5,261,488 | A | | 11/1993 | Gullet | |
| 5,433,484 | A | * | 7/1995 | Ewen et al. | 285/21.2 |
| 5,542,473 | A | | 8/1996 | Pringle | |
| 6,062,309 | A | | 5/2000 | Gosse | |
| 6,315,041 | B1 | | 11/2001 | Carlisle | |
| 6,318,469 | B1 | * | 11/2001 | Patel | 166/305.1 |
| 6,464,261 | B1 | * | 10/2002 | Dybevik et al. | 285/123.15 |
| 7,690,424 | B2 | | 4/2010 | McLeod | |
| 7,938,184 | B2 | * | 5/2011 | Yeh et al. | 166/278 |
| 8,225,863 | B2 | * | 7/2012 | Hammer et al. | 166/235 |
| 2003/0000607 | A1 | | 1/2003 | Jenner | |
| 2003/0183386 | A1 | * | 10/2003 | McGregor et al. | 166/278 |
| 2004/0055757 | A1 | | 3/2004 | Beall | |
| 2005/0224227 | A1 | | 10/2005 | Hendrie | |
| 2006/0060352 | A1 | * | 3/2006 | Vidrine et al. | 166/276 |
| 2007/0074872 | A1 | * | 4/2007 | Du et al. | 166/369 |
| 2008/0128129 | A1 | * | 6/2008 | Yeh et al. | 166/275 |
| 2009/0095471 | A1 | * | 4/2009 | Guignard et al. | 166/278 |
| 2009/0308592 | A1 | | 12/2009 | Mercer | |

FOREIGN PATENT DOCUMENTS

| | | |
|---|---|---|
| EP | 0468668 | 1/1992 |
| EP | 0485080 | 5/1992 |
| EP | 1408195 | 4/2004 |
| GB | 755082 | 8/1956 |
| GB | 1257790 | 12/1971 |
| GB | 1364054 | 8/1974 |
| GB | 2118659 | 11/1983 |
| GB | 2224526 | 5/1990 |
| GB | 2245624 | 8/1992 |
| GB | 2328230 | 2/1999 |
| GB | 2428708 | 2/2007 |
| WO | WO02/42672 | 5/2002 |
| WO | WO 2005/026494 | 3/2005 |
| WO | WO2005/121498 | 12/2005 |
| WO | WO2006/046075 | 5/2006 |
| WO | WO 2007/109878 | 10/2007 |

OTHER PUBLICATIONS

Pct-gb2005-001391, International Search Report, Jun. 23, 2005.
Pct-gb2005-001391, Written Opinion, Jun. 23, 2005.
Pct-gb2005-004200, Written Opinion, Apr. 10, 2006.
Pct-gb2005-004200, Int'l Prelim. Report on Patentability, May 1, 2007.
Pct-gb2005-004200, International Search Report, Jan. 11, 2006.
Pct-gb2005-003871 Int'l Prelim. Report on Patentability, Sep. 11, 2007.
Pct-gb2005-003871, International Search Report, Nov. 17, 2005.
Office Action dated Mar. 30, 2009, Applicant's co-pending U.S. Appl. No. 11/816,421.
Office Action dated Sep. 28, 2009, Applicant's co-pending U.S. Appl. No. 11/816,421.
Foreign (UK) Office Action dated Nov. 1, 2005.
Pct-gb2005-003871, Written Opinion, Nov. 22, 2005.
Pctgb2006001297, Int'l Prelim. Report on Patentability and Written Opinion, Oct. 9, 2007.
Pctgb2006001297, International Search Report, Oct. 9, 2007.
Office Action dated May 29, 2009, Applicant's co-pending U.S. Appl. No. 11/909,820.
Office Action dated Feb. 17, 2010, Applicant's co-pending U.S. Appl. No. 11/909,820, Feb. 19, 2010.
Pctgb2007001040, International Search Report, Jun. 5, 2010.
Pctgb2007001040, Int'l Prelim. Report on Patentability and Written Opinion, Sep. 23, 2008.
Pctgb2007004372, Int'l Prelim. Report on Patentability and Written Opinion, May 19, 2009.
Pctgb2007004372, International Search Report, Jan. 23, 2008.
Pctgb2008002042, Int'l Prelim. Report on Patentability and Written Opinion, Dec. 20, 2009.
Pctgb2008002042, International Search Report, Oct. 17, 2008.
Pctgb2009071874, Int'l Prelim. Report on Patentability and Written Opinion, Jun. 8, 2010.
Pctgb2009071874, International Search Report, Jul. 23, 2009.
Pct-gb2008003883, Int'l Prelim. Report on Patentability and Written Opinion, May 25, 2010.
Pctgb2008003883, International Search Report, Mar. 26, 2009.
PCTGB200900048300, Int'l Prelim. Report on Patentability and Written Opinion, Aug. 24, 2010.
PCTGB200900048300, International Search Report, Sep. 28, 2009.
Office Action dated Aug. 25, 2010, Applicant's co-pending U.S. Appl. No. 11/577,866.
Office Action dated Oct. 7, 2010, Applicant's co-pending U.S. Appl. No. 11/909,820.
Pursuant to MPEP § 2001.6(b) applicants bring the following co-pending or issued applications to the Examiner's attention: U.S. Appl. No. 12/866,495, U.S. Appl. No. 12/743,397, U.S. Appl. No. 12/743,505, U.S. Appl. No. 12/665,641, U.S. Appl. No. 12/514,488, U.S. Appl. No. 12/294,078, U.S. Appl. No. 11/909,820, U.S. Appl. No. 11/816,421, U.S. Appl. No. 11/577,866, U.S. Appl. No. 11/570,335, U.S. Appl. No. 12/743,397, U.S. Appl. No. 12/933,053, and U.S. Appl. No. 12/933,015.
International Search Report for PCT/GB2009/000730, Sep. 24, 2009.
Written Opinion for PCT/GB2009/000730, Sep. 18, 2010.
International Search Report for PCT/GB2009/000770, Oct. 8, 2009.
Written Opinion for PCT/GB2009/000770, Sep. 29, 2010.

* cited by examiner

TUBING SECTION

FIELD OF THE INVENTION

The present invention relates to an improved tubing section. Particularly, the present invention relates to an improved perforated tubing section.

BACKGROUND TO THE INVENTION

Perforated tubing is used to facilitate extraction of hydrocarbons from a formation zone. To extract the hydrocarbons, a bore is drilled down to and through the formation zone, and a section of tubing is lowered down into the bore. The annulus between the tubing and the wall of the bore is sealed above and below the zone by packers. The tubing is pre-perforated/slotted permitting hydrocarbons stored in the formation to enter the production tube and be recovered to surface.

Whilst this method of extraction is widely used, it does have drawbacks. For example, when the zone stops producing hydrocarbons and, for example, starts delivering water to the production tube, the section of perforated tube associated with that zone needs to be isolated so that the production tube can still be used to recover hydrocarbons from other formation zones. This isolation procedure can be a difficult and time-consuming process and often involves locating a sleeve on the internal surface of the perforated tube to seal the zone.

SUMMARY OF THE INVENTION

According to a first aspect of the present invention there is provided a tubing section comprising:

an outer skin defining at least one perforation;

an inner skin, the inner and outer skins being arranged to define a tubing annulus therebetween; and an access device to selectively provide fluid communication between the tubing annulus and a tubing section throughbore.

In an embodiment of the present invention, hydrocarbons from a formation zone flow through the perforated outer skin into the tubing annulus created by the inner and outer skins. From the tubing annulus, the hydrocarbons can flow through the access device into the tubing section throughbore and be recovered to surface. If it is desired to stop the flow of fluid from the formation zone into the tubing section, the access device can be closed thereby sealing the tubing annulus.

Preferably, the access device is movable from an open configuration in which fluid communication between the annulus and the tubing section throughbore is permitted, and a closed configuration in which fluid communication between the annulus and the inner skin throughbore is prevented.

Preferably, the access device is moved between the open and closed configurations remotely. Providing remote control of the access device permits, for example, the access device to be moved from the open to the closed configurations from a remote location such as the wellbore surface.

Preferably, the access device comprises a sleeve slidably mounted within a housing.

Preferably, the access device is moved from the open configuration to the closed configuration by relative movement of the access device sleeve and the access device housing.

Preferably, the access device is moved from the open configuration to the closed configuration by applying a force to the access device sleeve.

Preferably, the outer skin comprises one or more outer skin portions.

Preferably, each outer skin portion is a length of tubing.

Preferably, where there is more than one outer skin portion, the outer skin portions are coupled end-to-end to form the outer skin.

Preferably, adjacent outer skin portion ends are coupled together by means of an outer skin coupling.

Preferably, the inner skin comprises one or more inner skin portions.

Preferably, each inner skin portion is a length of tubing.

Preferably, where there is more than one inner skin portion, the inner skin portions are coupled end-to-end to form the inner skin.

Preferably, adjacent inner skin portion ends are coupled together by means of an inner skin coupling.

Preferably, the inner skin tubulars are longer then the outer skin tubulars.

Preferably, at least one of said outer skin and inner skin couplings defines at least one passage for providing fluid communication between a first annulus formed between a first outer skin portion and a first inner skin portion and a second, adjacent annulus formed between a second outer skin portion and a second inner skin portion.

Preferably, the outer skin coupling and the inner skin coupling are combined in a tubing section coupling.

Preferably, the tubing section coupling defines at least one passage for providing fluid communication between a first annulus formed between a first outer skin portion and a first inner skin portion and a second, adjacent annulus formed between a second outer skin portion and a second inner skin portion.

Preferably, the tubing section coupling defines a plurality of passages for providing fluid communication.

Preferably, each outer skin portion has a first end and a second end, each of the first and second ends defining an external thread.

Preferably, the tubing section coupling defines a first threaded surface for threadedly connecting with a threaded end of a first outer skin portion and a second threaded surface for threadedly engaging with a threaded end of a second outer skin portion.

Preferably, each inner skin portion comprises a first end and a second end, the first end being threaded and the second end being plain.

Preferably, the tubing section coupling defines a third threaded surface for threadedly engaging a threaded end of a first inner skin portion and a fourth plain surface adapted to form a sliding engagement with a plain end of a second inner skin portion. Providing a sliding engagement between the inner skin portion and the tubing section coupling facilitates assembly of the tubing section. This will be described in due course.

Preferably, the outer skin is adapted to be load bearing. The tensile, torsional and compressive loading to which the tubing section will be subject, is subjected to the outer skin. The inner skin is designed to be non-load bearing.

According to a second aspect of the present invention there is provided a method of extracting hydrocarbons from a formation, comprising:

disposing a tubing section adjacent a formation for which hydrocarbons are to be extracted;

permitting hydrocarbons to flow through a perforated outer tubing section skin into an annulus defined by the outer tubing section skin and an inner tubing section skin; and selectively permitting hydrocarbons to flow from the annulus into a tubing section throughbore through a tubing section access device.

BRIEF DESCRIPTION OF THE DRAWINGS

An embodiment of the present invention will now be described with reference to the accompanying drawings in which.

DETAILED DESCRIPTION OF THE DRAWINGS

Figure 1:
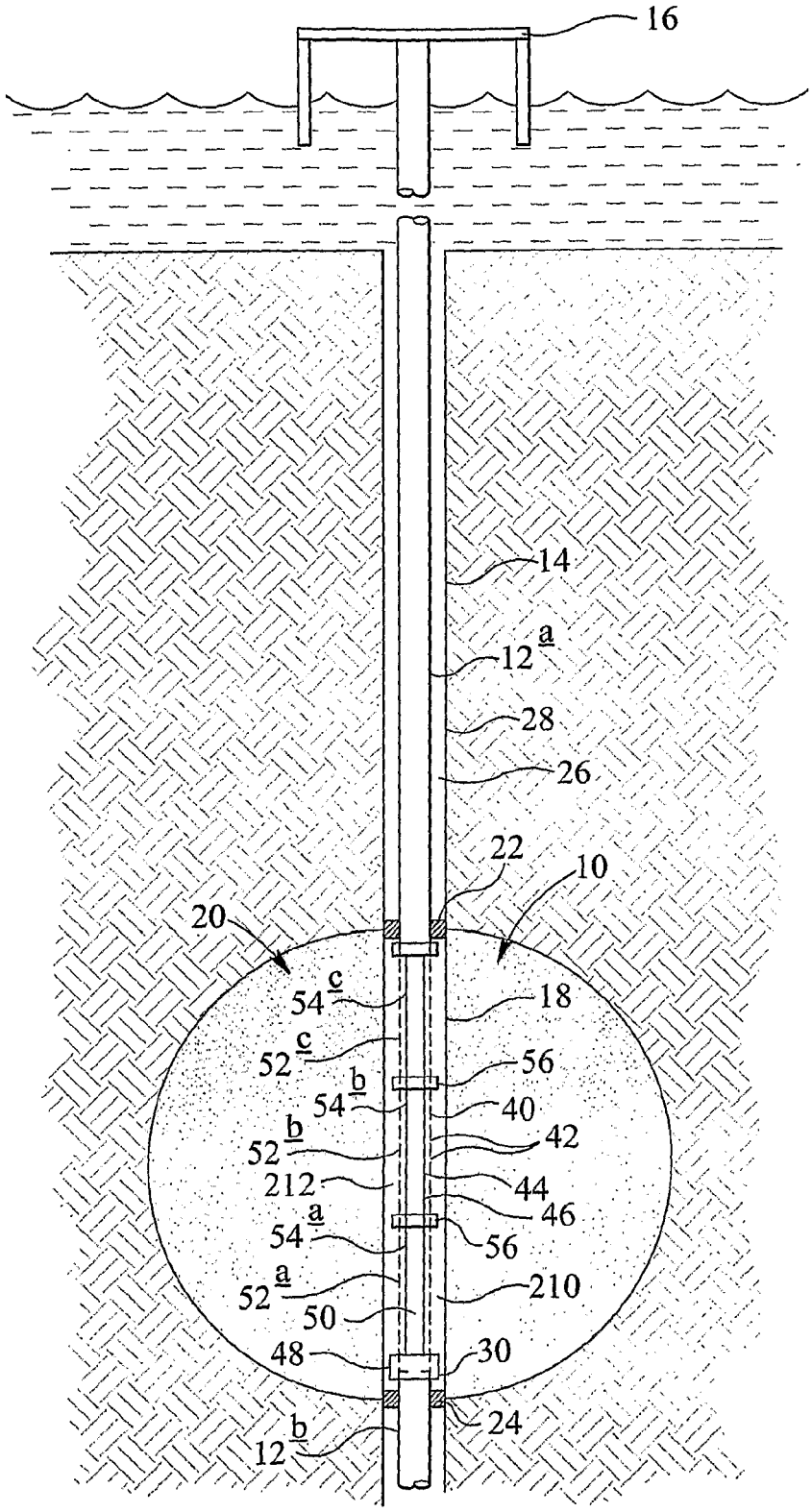
FIG. 1 is a schematic of a tubing section according to an embodiment of the present invention.

Referring firstly to FIG. 1, there is shown a schematic view of a tubing section generally indicated by reference numeral 10, according to an embodiment of the present invention. An upper end of the tubing section 10 is shown connected to a first length of production tube 12*a*, disposed within a subsea wellbore 14. The production tube 12 extends from the wellbore 14 up to a rig 16 located directly above the wellbore 14.

The tubing section 10 is disposed within a portion 18 of the wellbore 14. The wellbore portion 18 passes through a hydrocarbon bearing formation 20. The tubing section 10 facilitates extraction of hydrocarbons from the formation 20, and assists in recovery of the hydrocarbons to surface. The tubing section 10 is isolated within the wellbore section 18 by an upper packer 22 and a lower packer 24. These packers 22,24 ensure that hydrocarbons flowing from the formation 20 cannot flow up the well bore 14 to surface or down the well bore 14 via a wellbore annulus 26 between the production pipe 12 and the wellbore wall 28.

A lower end 30 of the tubing section 10 is connected to a second length of production tube 12*b* which extends to other formations (not shown) from which it is also desired to extract hydrocarbons.

The tubing section 10 will now be described in more detail. The tubing section 10 comprises an outer skin 40, defining a large number of perforations/slots 42, and an inner skin 44. The inner and outer skins 40,44 define a tubing annulus 46 therebetween. The tubing section 10 further comprises an access device 48 to selectively provide fluid communication between the tubing annulus 46 and a tubing section throughbore 50.

The outer skin 40 comprises three outer skin portions 52*a*,52*b*,52*c* and the inner skin 44 comprises three inner skin portions 54*a*,54*b*,54*c*. Each outer skin portion 52 is a length of perforated steel tubular and each inner skin portion 54 is a length of unperforated steel tubular. Adjacent lengths of outer skin tubular 52 and inner skin tubular 54 are connected together by a tubing section coupling 56.

Figure 2:
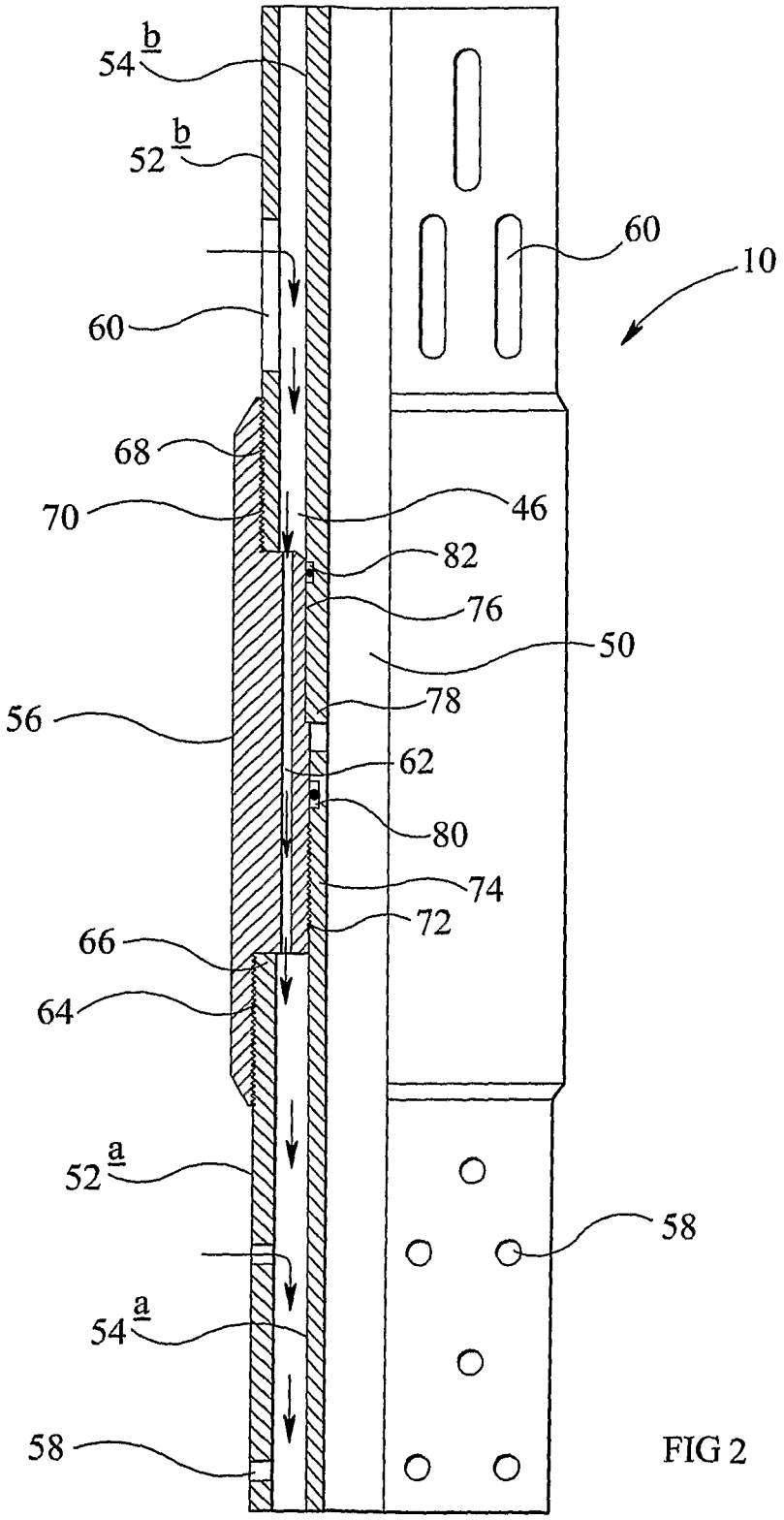
FIG. 2 is a partially cut-away view of part of the tubing section of FIG. 1.

Referring now to FIG. 2, a partially cut-away view of part of the tubing section 10 of FIG. 1. This Figure shows a first outer skin portion 52*a* and a first inner skin portion 54*a* connected, via a tubing section coupling 56, to a second outer skin portion 52*b* and a second inner skin portion 54*b*. As can be seen from FIG. 2 the first outer skin portion 52*a* comprises a plurality of circular perforations 58 and the second outer tubing section portion 52*b* comprises a plurality of elongate perforations 60. The outer skin perforations 58,60 permit hydrocarbons to flow from the formation 20 into the tubing section annulus 46. The coupling 56 includes twelve passages 62 in communication with the tubing annulus to permit the flow of hydrocarbons through the tubing section couplings 56 in the direction of the arrows, down to the access device 48 (not shown).

The tubing section coupling 56 comprises a threaded first surface 64 for engaging an external thread defined by an upper end 66 of the first outer skin portion 52*a*, and a threaded second surface 68 for engaging an external thread defined by a lower end 70 of the second outer skin portion 52*b*. The tubing section coupling 56 further defines a threaded third surface 72 for engaging an external thread defined by an upper end of 74 of the first inner skin portion 54*a* and a plain fourth surface 76 for engaging with a lower end 78 of the second inner skin portion 54*b*. The lower end 78 of the second inner skin portion 54*b* is also a plain surface. The plain surfaces 76,78 of the tubing section coupling 56 and the inner skin portion 54*b* engage in a sliding relationship. This facilitates assembly of the tubing section 10 which will be described in due course.

It will be noted that a first seal 80 is provided between the first inner skin portion end 74 and the tubing section coupling 56 and a second seal 82 is provided between the second inner skin portion end 78 and the tubing section coupling 56. These seals 80,82 are to prevent leakage between the inner skin portions 54 and the tubing section coupling 56 into the tubing section throughbore 50. This ensures that all of the hydrocarbons within the tubing section annulus 46 can only gain access to the tubing section tubular 50 through the access device 48.

Figure 3:
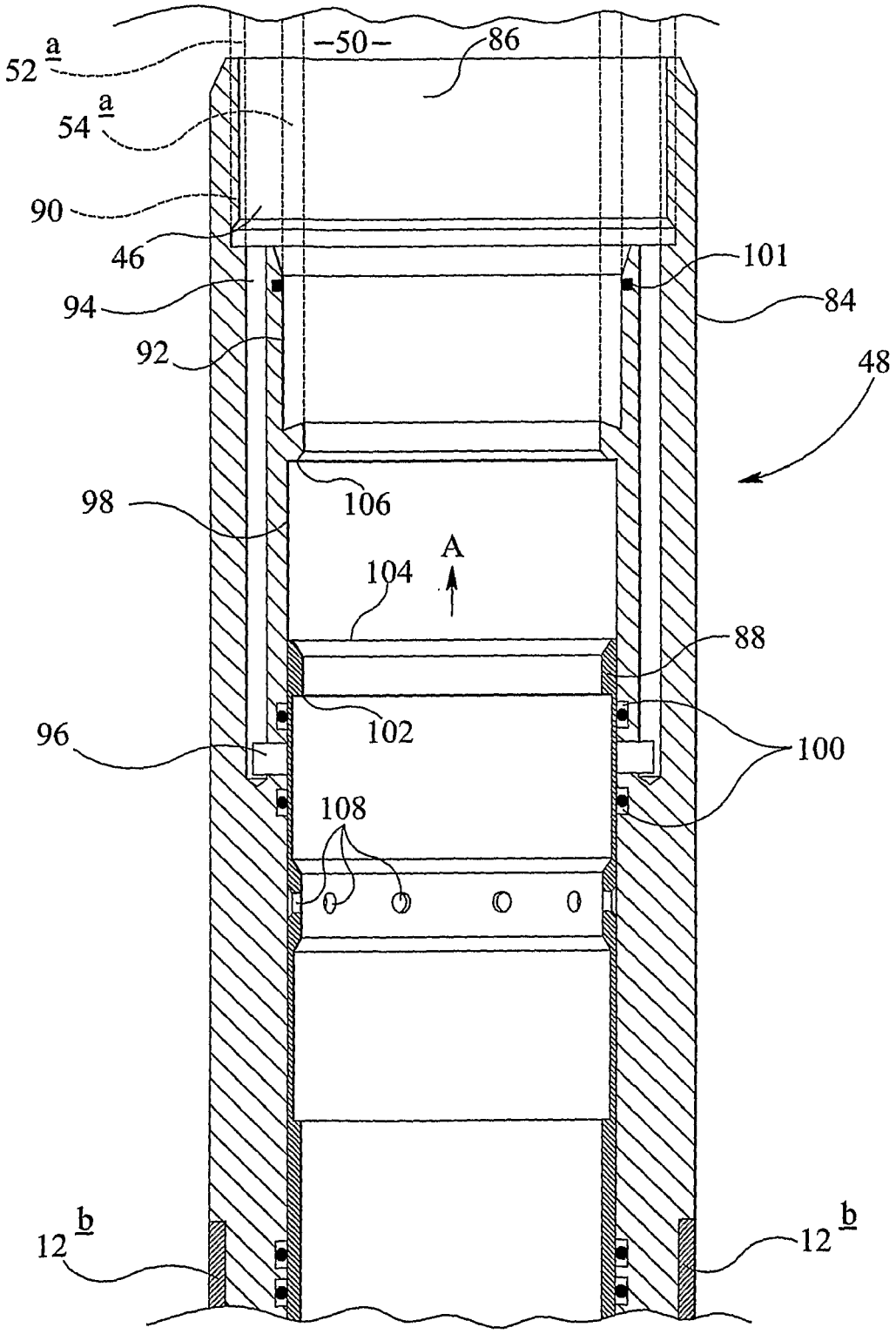
FIG. 3 is a section view of the access device of FIG. 1.

Referring now to FIG. 3, the access device 48 will now be described. The access device 48 comprises a housing 84, defining a housing throughbore 86 and a sliding member 88 mounted within the housing throughbore 86. The sliding member 88 is adapted to slide axially within the housing throughbore 86.

The housing 84 defines an internal threaded surface 90 adapted to engage with a threaded external surface defined by the lower end of the first outer skin portion 52*a* (shown in broken outline) and an internal plain surface 92 for engaging an external plain surface defined by the lower end of the first inner surface portion 54*a* (shown in broken outline). When the first outer surface portion 52*a* and the first inner surface portion 54*a* are connected to the access device 48, the tubing annulus 46 is in fluid communication with ten passages 94 defined by the access device housing 84. Each of the passages 94 permits fluid to flow within the housing 84 to a circumferential groove 96 defined by a housing throughbore internal surface 98.

In the position shown in FIG. 3, further flow of hydrocarbons from the passageway 94 to the groove 96 is prevented by the sliding member 88. Circumferential seals 100 are provided above and below the groove 96 to prevent leakage of fluid between the sliding member 88 and the throughbore internal surface 98 into the tubing section throughbore 50. An additional circumferential seal 101 is provided between the plain surfaces of the access device 48 and the lower end of the first inner skin portion 54*a* for the same reason.

When it is desired to permit the flow of fluid from the tubular annulus 46 into the tubing section throughbore 50, a pulling tool (not shown) is lowered from the rig 16 to engage an internal shoulder 102 defined by the sliding member 88. A pull force is applied to the sliding member 88 to pull the sliding member 88 axially upwards in the direction of arrow A. When an upper edge 104 of the sliding member 88 engages a shoulder 106 defined by the housing throughbore internal surface 98, the sliding member 88 can travel no further, and the pulling tool releases from the sliding member 88.

In this position a series of ten sliding member apertures 108, defined by the sliding member 88, are aligned with the circumferential groove 96 permitting flow through the sliding member into the housing throughbore 86 and the tubing section throughbore 50 for recovery to surface.

If it is desired to shut-off the flow through the tubing annulus 46 and to seal the formation 20, a push force is applied to the sliding member 88 in the direction of arrow B to return the sliding member 88 to the position shown in FIG. 3, in which the tubing annulus 46 is sealed.

To assemble the tubing section 10 the access device 48 is lowered and threadedly engaged onto an upper end of the second length of production tube 12*b*. A first unit 210 (FIG. 1) comprising the first outer skin portion 52*a*, the first inner skin portion 54*a* and a tubing section coupling 56 are lowered onto the access device 48. Because the first inner skin portion 54*a* is only in a sliding relationship with the access device 48, the only threaded connection to be made is between the first outer skin portion 52*a* and the access device internal threaded surface 90. Rotation of the first unit 210 will make the threaded connection between the first outer skin portion 52*a* and the access device 48. If both the first outer skin portion 52*a* and the first inner skin portion 54*a* were in a threaded connection with the access device 48, then the threads would have to be matched to ensure both portions 52*a*,54*a* could be connected to the access device 48 at the same time.

Once the first unit 210 is connected to the access device 48, a second unit 212 comprising the second outer skin portion 52*b*, the second inner skin portion 54*b* and a further tubing section 56 coupling can be connected to the tubing section coupling 56 of the first unit 210. In this way, the tubing section 10 can be made up. The provision of a sliding relationship between the lower ends of the inner skin portions 54 and the tubing section couplings 56 facilitates assembly of the tubing section 10.

Various improvements and modifications can be made to the above described embodiment without departing from the scope of the invention. For example, although circular and elongate perforations are shown, any suitable perforation could be used. Additionally, although the access device 48 is shown at the bottom of the tubing section 10, it could be located at the top of the tubing section or indeed there could be an access device at each end of the tubing section. In these examples, the flow of hydrocarbons may, at least partially, be up the annulus 46.

Furthermore, although the access device 48 is shown in a closed configuration in FIG. 2, it may be run-into the bore in an open configuration and subsequently moved to the closed configuration.

In a further alternative, the sliding member 88 can be moved by dropping an RFID Tag to enable an atmospheric chamber and or a pump/motor combination to drive the sliding member 88.

In further embodiments there may less than or more than ten sliding member apertures.

The invention claimed is:

1. A tubing section having a tubing section throughbore, the tubing section comprising:

an outer skin defining at least one perforation, the outer skin comprising at least two outer skin portions;

an inner skin being arranged to define a first portion of the tubing section throughbore and comprising at least two inner skin portions, the inner and outer skins being arranged to define a tubing annulus therebetween;

a tubing section coupling combining an inner skin coupling for coupling adjacent ones of the at least two inner skin portions and an outer skin coupling for coupling adjacent ones of the at least two outer skin portions, the tubing section coupling being arranged to define a second portion of the tubing section throughbore and being arranged to communicate adjacent portions of the tubing annulus, wherein each of the at least two inner skin portions comprises a first threaded end and a first plain end, the first plain end of a first of the at least two inner skin portions slidingly engaging the tubing section coupling; and an access device coupled to the inner and outer skins and being arranged to define a third portion of the tubing section throughbore, the access device terminating an end the tubing annulus of the tubing section and adapted to selectively provide fluid communication between the terminated end of the tubing annulus and a the tubing section throughbore.

2. The tubing section of claim 1, wherein the access device is moveable from an open configuration in which fluid communication between the terminated end of the tubing annulus and the tubing section throughbore is permitted, and a closed configuration in which fluid communication between the terminated end of the tubing annulus and the tubing section throughbore is prevented.

3. The tubing section of claim 2, wherein the access device is configured to be moved between the open and closed configurations remotely.

4. The tubing section of claim 2, wherein the access device is moved from the open configuration to the closed configuration by applying a force to an access device sleeve.

5. The tubing section of claim 1, wherein each of the at least two outer skin portions is a length of tubing.

6. The tubing section of claim 1, wherein each of the at least two inner skin portions is a length of tubing.

7. The tubing section of claim 1, wherein inner skin tubulars for the inner skin are longer than outer skin tubulars for the outer skin.

8. The tubing section of claim 1, wherein to communicate the adjacent portions of the tubing annulus, the tubing section coupling defines at least one passage for providing fluid communication between a first of the adjacent portions of the tubing annulus formed between a first of the at least two outer skin portions and a first of the at least two inner skin portions and a second of the adjacent portions of the tubing annulus formed between a second of the at least two outer skin portions and a second of the at least two inner skin portions.

9. The tubing section of claim 8, wherein the tubing section coupling defines a plurality of the at least one passages for providing fluid communication.

10. The tubing section of claim 1, wherein each of the at least two outer skin portions has second threaded ends defining external thread.

11. The tubing section of claim 10, wherein the tubing section coupling defines a first threaded surface for threadedly connecting with the second threaded end of a first of the adjacent outer skin portions and a second threaded surface for threadedly engaging with the second threaded end of a second of the adjacent outer skin portions.

12. The tubing section of claim 1, wherein the tubing section coupling defines a threaded surface for threadedly engaging the first threaded end of a first of the adjacent inner skin portions and a plain surface adapted to form a sliding engagement with the first plain end of a second of the adjacent inner skin portions.

13. The tubing section of claim 1, wherein the outer skin is adapted to be load bearing.

14. The tubing section of claim 1, wherein the access device comprises a sleeve slidably mounted within a housing.

15. The tubing section of claim 14, wherein the access device is moved from the open configuration to the closed configuration by relative movement of the sleeve and the housing.

16. The tubing section of claim 1, comprising a seal between the first plain end of the first inner skin portion and the tubing section coupling.

17. The tubing section of claim 1, wherein at least one of:

the at least two inner skin portions are coupled end-to-end to form the inner skin; and the at least two outer skin portions are coupled end-to-end to form the outer skin.

18. The tubing section of claim 1, wherein the access device comprises:

an internal threaded surface disposed at a first portion of the access device and threading to a second threaded end of one of the at least two outer skin portions; and an internal plain surface disposed at the first portion and engaging the first plain end of a second of the at least two inner skin portions.

19. The tubing section of claim 18, comprising a seal disposed between the first plain end and the internal plain surface.

20. The tubing section of claim 18, wherein the access device couples at a second portion of the access device to an additional tubular.

21. The tubing section of claim 1, wherein the access device defines at least one passage in fluid communication with the tubing annulus and having the terminated end.

22. The tubing section of claim 21, wherein the terminated end of the at least one passage defines a circumferential groove defined in an internal surface of the access device.

23. The tubing section of claim 1, further comprising an upper packer and a lower packer isolating the tubing section in a wellbore.

24. A method of extracting hydrocarbons from a formation, comprising:

making up a tubing section having a tubing section throughbore and comprising: an outer skin defining at least one perforation, the outer skin comprising at least two outer skin portions; an inner skin being arranged to define a first portion of the tubing section throughbore and comprising at least two inner skin portions, the inner and outer skins arranged to define a tubing annulus therebetween; a tubing section coupling combining an inner skin coupling for coupling adjacent ones of the at least two inner skin portions and an outer skin coupling for coupling adjacent ones of the at least two outer skin portions, the tubing section coupling being arranged to define a second portion of the tubing section throughbore and being arranged to communicate adjacent portions of the tubing annulus, wherein each of the at least two inner skin portions comprises a first threaded end and a first plain end, the first plain end of a first of the at least two inner skin portions slidingly engaging the tubing section coupling; and an access device coupled to the inner and outer skins and being arranged to define a third portion of the tubing section throughbore, the access device terminating an end the tubing annulus of the tubing section and adapted to selectively provide fluid communication between the terminated end of the tubing annulus and the tubing section throughbore;

disposing the tubing section adjacent a formation for which hydrocarbons are to be extracted;

permitting hydrocarbons to flow through the at least one perforation in the outer skin into the tubing annulus defined by the outer skin and the inner skin; and selectively permitting hydrocarbons to flow from the terminated end of the tubing annulus into the tubing section throughbore through the access device.

25. The method of claim 24, wherein selectively permitting the hydrocarbons to flow comprises enabling relative movement of an access device sleeve and an access device housing to selectively permit the hydrocarbons to flow from the terminated end of the tubing annulus into the tubing section throughbore.

26. The method of claim 24, comprising at least one of:

coupling the at least two inner skin portions end-to-end to form the inner skin; and coupling the at least two outer skin portions end-to-end to form the outer skin.

27. The method of claim 24, wherein selectively permitting the hydrocarbons to flow from the terminated end of the tubing annulus into the tubing section throughbore through the access device comprises moving the access device between open and closed configurations remotely or by applying a force.

28. The method of claim 24, wherein permitting the hydrocarbons to flow through the at least one perforation in the outer skin into the tubing annulus defined by the outer skin and the section skin comprises providing fluid communication in at least one passage of the tubing section coupling between the adjacent portions of the tubing annulus.

29. The method of claim 24, wherein making up the tubing section comprises:

threading a first threaded surface of the tubing section coupling with a second threaded end of a first of the at least two outer skin portions; and threading a second threaded surface of the tubing second coupling with the second threaded end of a second of the at least two outer skin portions.

30. The method of claim 24, wherein making up the tubing section comprises:

threading a threaded surface of the tubing section coupling to the first threaded end of a second of the at least two inner skin portions; and engaging a plain surface of the tubing section coupling with the first plain end of the first of the at least two inner skin portions.

31. The method of claim 24, wherein making up the tubing section comprises:

threading a threaded surface disposed at a first portion of the access device to a second threaded end of one of the at least two outer skin portions; and engaging a plain surface disposed at the first portion with the first plain end of a second of the at least two inner skin portions.

32. The method of claim 31, comprising sealing between the first plain end and the plain surface with a seal.

33. The method of claim 24, wherein making up the tubing section comprises coupling the access device to an additional tubular.

34. The method of claim 24, wherein selectively permitting the hydrocarbons to flow from the terminated end of the tubing annulus into the tubing section throughbore through the access device comprises communicating flow in at least one passage of the access device in fluid communication with the tubing annulus and having the terminated end.

35. The method of claim 24, wherein disposing the tubing section adjacent the formation for which hydrocarbons are to be extracted further comprising isolating the tubing section in the wellbore with an upper packer and a lower packer.

36. A tubing section unit comprising:

an outer skin portion defining at least one perforation;

an inner skin portion having a throughbore, the inner and outer skin portions being arranged to define a tubing annulus therebetween;

a tubing section coupling, wherein the inner and outer skin portions are coupled to the tubing section coupling; and an access device coupled to the inner and outer skin portions, the access device terminating an end of the tubing annulus and adapted to selectively provide fluid communication between the terminated end of the tubing annulus and the throughbore, wherein the inner skin portion comprises a first threaded end coupled to the tubing section coupling and comprises a first plain end for slidingly engaging one of: the access device and another tubing section coupling of another tubing section unit, wherein the outer skin portion comprises a second threaded end coupled to the tubing section coupling and comprises a third threaded end for threadedly engaging one of: said access device and said other tubing section coupling of said other tubing unit, and wherein the tubing section coupling defines at least one passage providing fluid communication between the tubing annulus and an adjacent tubing annulus formed between another outer skin portion and another inner skin portion of said other tubing section unit.

37. A tubing section unit comprising:

an outer skin portion defining at least one perforation;

an inner skin portion having a throughbore, the inner and outer skin portions being arranged to define a tubing annulus therebetween;

a tubing section coupling, wherein the inner and outer skin portions are coupled to the tubing section coupling; and an access device coupled to the inner and outer skin portions, the access device terminating an end the tubing annulus and adapted to selectively provide fluid communication between the terminated end of the tubing annulus and the throughbore, wherein the inner skin portion comprises a first threaded end coupled to the tubing section coupling and comprises a first plain end for slidingly engaging one of: the access device and another tubing section coupling of another tubing section unit, wherein the outer skin portion comprises a second threaded end coupled to the tubing section coupling and comprises a third threaded end for threadedly engaging one of: said access device and said other tubing section coupling of said other tubing section unit, and wherein said outer skin portion is a length of tubing and said inner skin portion is a length of tubing, said inner skin tubing being longer than said outer skin tubing.

38. A method of constructing a tubing section unit, comprising:

providing an outer skin portion defining at least one perforation and an inner skin portion having a throughbore;

arranging the inner and outer skin portions to define a tubing annulus therebetween;

coupling said inner and outer skin portions to a tubing section coupling and to an access device, the access device terminating an end of the tubing annulus and adapted to selectively provide fluid communication between the terminated end of the tubing annulus and the throughbore, wherein the inner skin portion comprises a first threaded end coupled to the tubing section coupling and comprises a first plain end for slidingly engaging one of: the access device and another tubing section coupling of another tubing section unit, wherein the outer skin portion comprises a second threaded end coupled to the tubing section coupling and comprises a third threaded end for threadedly engaging one of: said access device and said other tubing section coupling of said other tubing section unit, and wherein the tubing section coupling defines at least one passage providing fluid communication between the tubing annulus and an adjacent tubing annulus formed between another outer skin portion and another inner skin portion of said other tubing section unit.

39. A method of constructing a tubing section unit, comprising:

providing an outer skin portion defining at least one perforation and an inner skin portion having a throughbore;

arranging the inner and outer skin portions to define a tubing annulus therebetween;

coupling said inner and outer skin portions to a tubing section coupling and to an access device, the access device terminating an end of the tubing annulus and adapted to selectively provide fluid communication between the terminated end of the tubing annulus and the throughbore, wherein the inner skin portion comprises a first threaded end coupled to the tubing section coupling and comprises a first plain end for slidingly engaging one of: the access device and another tubing section coupling of another tubing section unit, wherein the outer skin portion comprises a second threaded end coupled to the tubing section coupling and comprises a third threaded end for threadedly engaging one of said access device and said other tubing section coupling of said other tubing section unit, and wherein said outer skin portion is a length of tubing and said inner skin portion is a length of tubing, said inner skin tubing being longer than said outer skin tubing.

* * * * *